US010317843B2

(12) United States Patent
Cosandier et al.

(10) Patent No.: US 10,317,843 B2
(45) Date of Patent: Jun. 11, 2019

(54) MECHANICAL OSCILLATOR FOR A HOROLOGICAL MOVEMENT

(71) Applicant: CSEM Centre Suisse d'Electronique et de Microtechnique SA—Recherche et Developpement, Neuchatel (CH)

(72) Inventors: Florent Cosandier, Colombier (CH); Emmanuel Domine, Peseux (CH); Gregory Musy, Le-Mont-sur-Lausanne (CH); François Barrot, Erlach (CH)

(73) Assignee: CSEM CENTRE SUISSE D'ELECTRONIQUE ET DE MICROTECHNIQUE SA—RECHERCHE ET DEVELOPPEMENT, Neuchâtel (CH)

( * ) Notice: Subject to any disclaimer, the term of this patent is extended or adjusted under 35 U.S.C. 154(b) by 114 days.

(21) Appl. No.: 15/715,377

(22) Filed: Sep. 26, 2017

(65) Prior Publication Data

US 2018/0088529 A1 Mar. 29, 2018

(30) Foreign Application Priority Data

Sep. 27, 2016 (EP) ..... 16190886

(51) Int. Cl.
*G04B 17/04* (2006.01)

(52) U.S. Cl.
CPC ..... *G04B 17/045* (2013.01)

(58) Field of Classification Search
CPC ..... G04B 17/00; G04B 17/04; G04B 17/045; G04B 17/08; G04B 17/10; G04B 15/14; Y10T 29/4957; Y10T 29/49787
See application file for complete search history.

(56) References Cited

U.S. PATENT DOCUMENTS 3,277,394 A 10/1966 Holt et al.
3,352,000 A * 11/1967 Altenburger ..... G04B 17/045 228/136
9,323,222 B2 * 4/2016 Stranczl ..... G04B 15/14
(Continued)

FOREIGN PATENT DOCUMENTS

EP 2090941 A1 8/2009

OTHER PUBLICATIONS

European Search Report dated May 18, 2017 for EP16190886.8.

*Primary Examiner* — Edwin A. Leon
*Assistant Examiner* — Jason M Collins
(74) *Attorney, Agent, or Firm* — Pearne & Gordon LLP

(57) ABSTRACT

Mechanical oscillator for a horological movement, comprising: a central fixed part being configured to be fixed to a frame of the horological movement; an inertial rim coaxial with a pivoting axis of the mechanical oscillator; at least two rigid links extending radially between the central fixed part and the inertial rim and supporting the inertial rim; and at least two flexible links extending radially from the central fixed part; each flexible link comprising a first flexible element and a second flexible element substantially coplanar to the first element, the first flexible element and the second flexible element being rigidly connected at their distal extremity; the proximal extremity of the first flexible element being fixed to the fixed part and the proximal extremity of the second flexible element being fixed to one of said at least two rigid links, such that the inertial rim can oscillate around the pivoting axis.

15 Claims, 7 Drawing Sheets

(56) References Cited

U.S. PATENT DOCUMENTS

| | | | | |
|---|---|---|---|---|
| 9,541,902 | B2 * | 1/2017 | Stranczl | G04B 15/14 |
| 9,921,547 | B2 * | 3/2018 | Cusin | G04B 15/14 |
| 2016/0011567 | A1 | 1/2016 | Stranczl | |

* cited by examiner

MECHANICAL OSCILLATOR FOR A HOROLOGICAL MOVEMENT

FIELD

The present invention concerns a mechanical oscillator for a horological movement that has a very low isochronism error and that is insensitive to the direction of gravity. The present invention also concerns a horological movement comprising the mechanical oscillator.

DESCRIPTION OF RELATED ART

A regulating device is the heart of a mechanical watch. It generates oscillations which separate the time into equal units and is responsible for the accuracy of the watch. In a conventional mechanical watch, the regulating device comprises a balance, a spiral spring and an pallet anchor escapement.

In a conventional regulating device, energy losses can be significant due to friction at the pivot of the balance and pallet anchor and of the different interfaces. The accuracy of the spiral spring can also be affected by its orientation of in space. Problems due to flat-hanging difference affect the isochronism of the watch and increase dry friction.

Patent EP2090941 to the present applicant describes an oscillatory system constituted of a balance and a return spring. A frequency correction device has flexible elastic straps that are supported on a T-shaped connection member or stop. The straps have ends connected to a fixation and adjusting interface via pins using locking screws, respectively. The interface is secured to a frame by a screw, and the member or stop is directly fixed to the balance. The member or stop is pressed against free ends of the straps during a part of oscillation period. The oscillatory system can significantly increase the power reserve of the watch.

However, the oscillatory system described in this document is sensitive to the direction of gravity. Indeed, the displacement of the center of mass effect create a "pendulum" effect that affects the stiffness of the blade, changing slightly the frequency of the pendulum.

SUMMARY

The present disclosure concerns a mechanical oscillator for a horological movement, the oscillator comprising: a central fixed part being configured to be fixed to a frame of the horological movement; an inertial rim coaxial with a pivoting axis of the mechanical oscillator; at least two rigid links extending radially between the central fixed part and the inertial rim and supporting the inertial rim; and at least two flexible links extending radially from the central fixed part; each flexible link comprising a first flexible element and a second flexible element substantially coplanar to the first element, the first flexible element and the second flexible element being rigidly connected at their distal extremity; the proximal extremity of the first flexible element being fixed to the fixed part and the proximal extremity of the second flexible element being fixed to one of said at least two rigid links, such that the inertial rim can oscillate around the pivoting axis; the first flexible element comprising two first blades and the second flexible element comprises one second blade coplanar with said first blades, the second blade being between the two first blades.

The mechanical oscillator provides a very low isochronism error and has a low sensitivity to the direction of gravity. The stiffness of the flexible elements during the oscillation of the mechanical oscillator is constant. Deficiencies in the isochronism can be cancelled by a proper design of the mechanical oscillator, in particular by adjusting a ratio of a distance between the proximal extremity of the second flexible element and the pivoting axis, over the length of the flexible elements. The pivoting axis does not shift during the oscillation such that the mechanical oscillator has a low energy consumption. Moreover, the movable parts of the oscillator are not subjected to any friction, except with the surrounding air. The mechanical oscillator can be made of non-magnetic materials such as silicon.

BRIEF DESCRIPTION OF THE DRAWINGS

The invention will be better understood with the aid of the description of an embodiment given by way of example and illustrated by the figures, in which.

DETAILED DESCRIPTION OF POSSIBLE EMBODIMENTS

Figure 1:
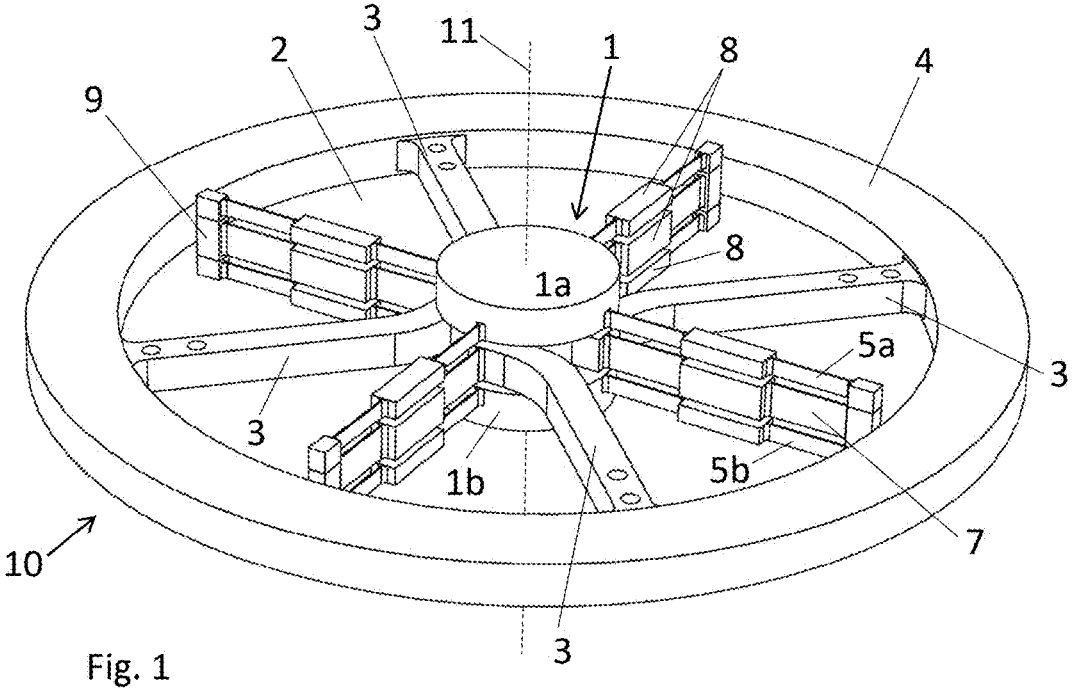
FIG. 1 shows a perspective view of a mechanical oscillator, according to an embodiment.

FIG. 1 shows a perspective view of a mechanical oscillator 10 according to an embodiment. The mechanical oscillator 10 comprises a central fixed part 1, an inertial rim 4 coaxial with a pivoting axis 11 of the mechanical oscillator, four rigid links 3 extending radially between the central fixed part 1 and the inertial rim 4 and supporting the inertial rim 4. The central fixed part 1 is configured to be fixed to a frame, or any fixed part, of a timepiece movement.

The mechanical oscillator 10 further comprises four flexible links 2 extending radially from the central fixed part 1. The four flexible links 2 and the four rigid links 3 are angularly equally spaced. However, other arrangements are also possible. Each flexible link 2 comprises a first flexible element 5 and a second flexible element 7 substantially coplanar to the first element 5. Each of the first flexible element 5 and the second flexible element 7 is rigidly connected at their distal extremity. The proximal extremity of the first flexible element 5 is fixed to the fixed part 1 and the proximal extremity of the second flexible element 7 being fixed to one of the four rigid links 3, such that the inertial rim 4 can oscillate around the pivoting axis 11.

The oscillation movement of the mechanical oscillator 10 can be transmitted to an escapement (not shown) of a regulator in a horological instrument.

The first flexible element 5 and the second flexible element 7 are configured to bend substantially perpendicular to their radial extension. When the inertial rim 4 is pivoted around the pivoting axis 11 for a given angle, the first flexible element 5 and the second flexible element 7 bend such to exert a return force opposed to the pivoting direction. The inertial rim 4 can thus oscillate around an equilibrium angular position around the pivoting axis 11.

As shown in FIG. 1, the first flexible element 5 comprises a two first blades 5*a*, 5*b* and the second flexible element 7 comprises a single second blade 7. The two first blades 5*a*, 5*b* and the second blade 7 are arranged coplanar in a plane passing through the pivoting axis 11. In the special arrangement of FIG. 1, the central fixed part 1 comprised a first fixed part 1*a* and a second fixed part 1*b* coaxial with the first fixed part 1*a*. One of the first blades 5*a* is fixed to the first fixed part 1*a* while the other first blade 5*b* is fixed to the second fixed part 1*b*. The distal extremity of the two first blades 5*a*, 5*b* is fixed to the second blade 7. In the example of FIG. 1, the distal extremity of the two first blades 5*a*, 5*b* is connected to the second blade 7 through a distal connecting element 9. The second blade 7 can have a width that is substantially twice the width of the two first blades 5*a*, 5*b*.

The configuration of the first flexible element 5 and the second flexible element 7 allows for guiding the movement of the inertial rim 4 in a way that only a rotation movement around the pivoting axis 11 is possible.

The mechanical oscillator 10 is geometrically symmetric with the ring-shaped inertial rim 4 and disc-shaped first and second fixed parts 1*a*, 1*b*, and the center of mass does not move when the inertial rim 4 is pivoted. The distal extremity of the first and second flexible element 5, 7 are not fixed and can move freely radially. The mechanical oscillator 10 thus has a constant stiffness (flexibility) and a high degree of isochronism. The symmetry of the mechanical oscillator 10 further allows for limiting a possible twisting effect on the distal connecting element 9.

In an embodiment, a middle stiffening element 8 is comprised in a middle portion of the first and second flexible elements 5, 7. The middle stiffening element 8 increases the stiffness of the first and second flexible elements 5, 7, out of the plane of the flexible elements 5, 7, and thus increases the resistance to shocks and perturbations of the mechanical oscillator 10. In that case, each of the first blades 5*a*, 5*b* and the second blade 7 have a middle stiffening element 8, independent from the middle stiffening element 8 of the other blades 5*a*, 5*b*, 7 such that each blade 5*a*, 5*b*, 7 can bend independently from each other.

Moreover, the distal connecting element 9 can play the role of a stiffening element or can comprise a distal stiffening element 15 (see FIG. 3) The distal stiffening element 15 can be used for assembling and positioning the first and second flexible elements 5, 7.

Figure 2A:
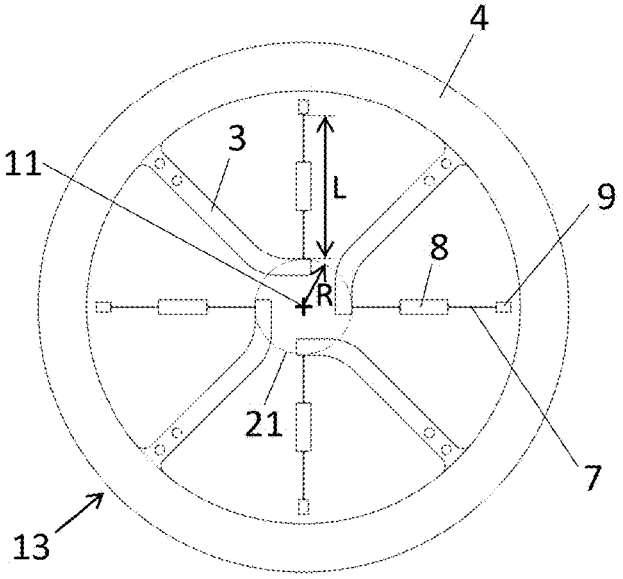
FIGS. 2*a* and 2*b* show a top view of parts of the mechanical oscillator of FIG. 1.
Figure 2B:
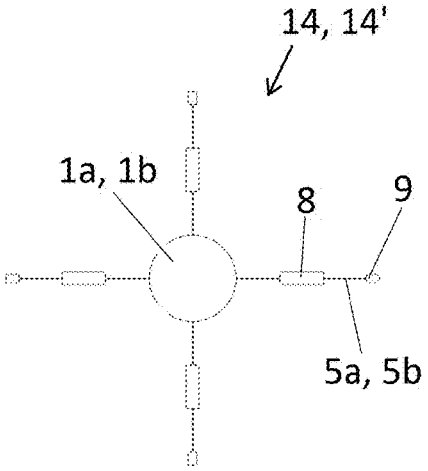

FIGS. 2*a* and 2*b* show a top view of parts of the mechanical oscillator 10 of FIG. 1, according to an embodiment. In particular, FIG. 2*a* shows a central part 13 of the mechanical oscillator 10 comprising the four rigid links 3, the inertial rim 4 and the four second blades 7, each having a middle stiffening element 8. Each of the four second blades 7 is fixed at their proximal extremity to a respective rigid link 3 and comprises a distal connecting element 9 at their distal extremity. The second blades 7 extend radially from proximal end of the rigid link 3. FIG. 2*b* shows a upper part 14 of the mechanical oscillator 10 comprising the four first blades 5*a* connected to the first fixed part 1*a* at their proximal extremity. Each of the four first blades 5*a* are also provided with a middle stiffening element 8 and a distal connecting element 9 at their distal extremity.

The complete mechanical oscillator 10 can then be formed by assembling the central part 13 with the upper part 14 on top of the central part 13 and a lower part 14', identical to the upper part 14 and represented by the same FIG. 2*b*, beneath the central part 13. During the assembly, the connecting elements 9 of the second blade 7 can be connected to the connecting elements 9 of the first blades 5*a*, 5*b*.

The first blades 5*a* of the upper part 14 and the first blades 5*b* of the lower part can have the same width, such that the stiffness (flexibility) of the first blades 5*a*, 5*b* is the same for the upper part 14 and the lower part.

Figure 3:
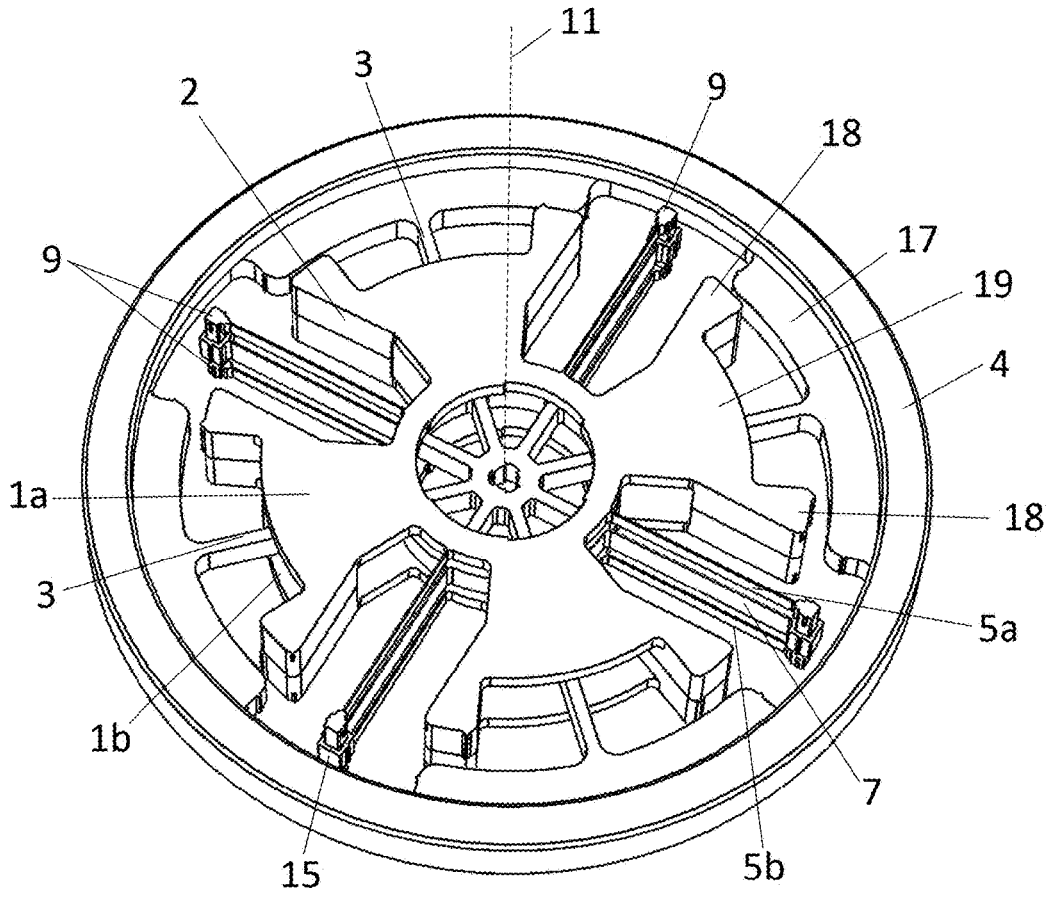
FIG. 3 shows a perspective view of the mechanical oscillator, according to another embodiment.

FIG. 3 shows a perspective view of the mechanical oscillator 10 according to another embodiment. In this embodiment, the first flexible element 5 comprises two first blades 5*a*, 5*b* and the second flexible element comprise a single blade 7 as in the example of FIG. 1. However, the first and second first flexible elements 5, 7 do not comprise a middle stiffening element 8. The second blade 7 can have a width that is substantially twice the width of the two first blades 5*a*, 5*b*.

Figure 4A:
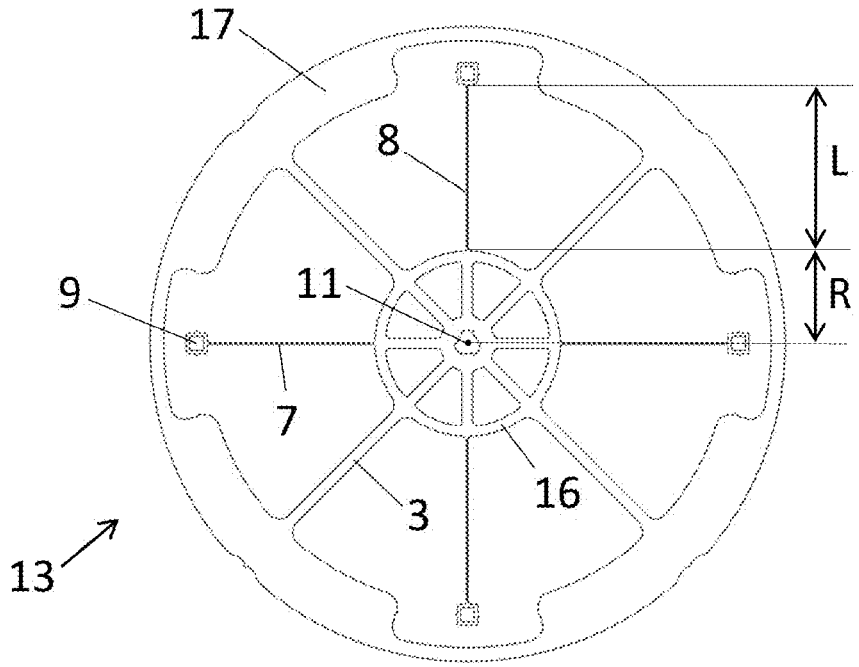
FIGS. 4*a* and 4*b* show a top view of parts of the mechanical oscillator of FIG. 3.
Figure 4B:
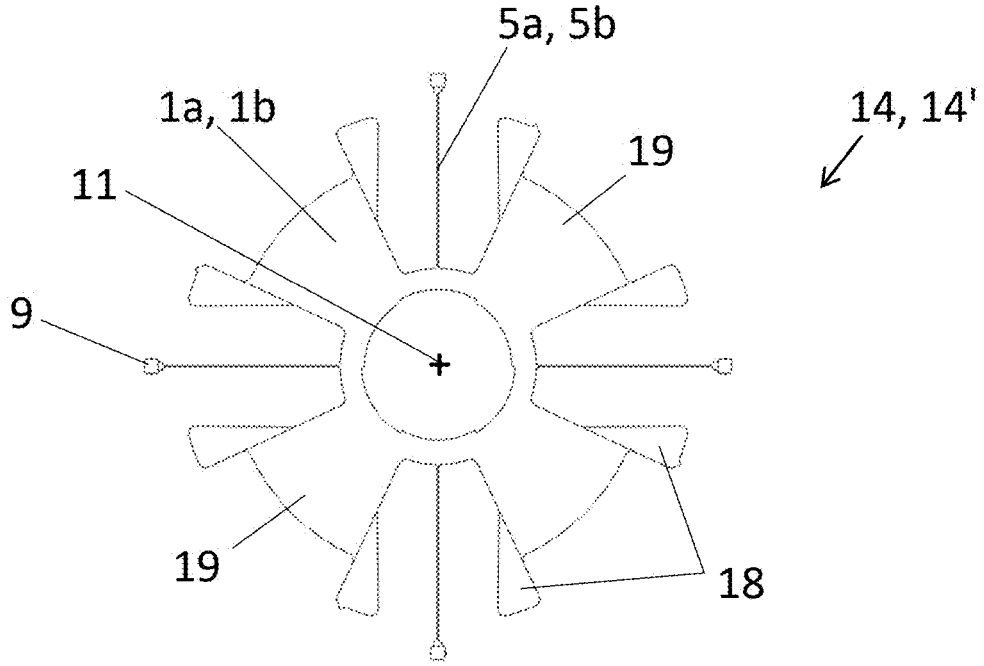

FIGS. 4*a* and 4*b* show a top view of parts of the mechanical oscillator 10 of FIG. 3, according to an embodiment. In particular, FIG. 4*a* shows a central part 13 of the mechanical oscillator 10 comprising the four rigid links 3, the inertial rim 4 and the four second blades 7. Each of the four second blades 7 is fixed at their proximal extremity to the rigid links 3 via a rigid ring 16 and comprises a distal connecting element 9 at their distal extremity. In this specific embodiment, the rigid links 3 extend radially from the rigid ring 16 and support a rigid external ring 17 to which the inertial rim 4 is rigidly connected. FIG. 4*b* shows a upper part 14 of the mechanical oscillator 10 comprising the four first blades 5*a* connected to the first fixed part 1*a* at their proximal extremity. Each of the four first blades 5*a* are also provided with a distal connecting element 9 at their distal extremity.

The complete mechanical oscillator 10 of FIG. 3 can then be formed by assembling the central part 13 with the upper part 14 on top of the central part 13 and a lower part 14', identical to the upper part 14 and represented by the same FIG. 4*b*, beneath the central part 13. During the assembly, the connecting elements 9 of the second blade 7 can be connected to the connecting elements 9 of the first blades 5*a*, 5*b*.

As shown in the FIGS. 3 and 4*b*, the first fixed part 1*a* and the second fixed part 1*b* comprise four protruding portions 19 extending radially from the pivoting axis 11. The four protruding portions 19 are angularly distributed such as to extend between the first blades 5*a*, 5*b* and be aligned with the four rigid links 3 when the upper part 14, lower part 14' and the central part 13 are assembled. Each of the protruding portions 19 can comprise two abutments 18. The abutments 18 can be used for limiting the amplitude of the pivoting movement of the inertial rim 4, for example by abutting on the rigid links 3 when the inertial rim 4 oscillates.

A length L of the flexible link 2 can be defined as a distance between the proximal extremity of the flexible link 2 fixed to the central fixed part 1, and the distal extremity of the flexible link 2 fixed to the distal connecting element 9. A radius R can be defined as a distance between the fixation point of the second flexible element 7 (or proximal extremity of the second flexible element 7) of the flexible link 2 to one of the rigid links 3 and the pivoting axis 11.

In the configuration of FIGS. 3 and 4*a*, the length L is the distance between the proximal extremity of the flexible link 2 fixed to the rigid ring 16 and its distal extremity fixed to the distal connecting element 9. The radius R corresponds to the radius of the rigid ring 16. In the configuration of FIGS. 1 and 2*a*, the radius R can be defined as the distance between the pivoting axis 11 and the point where the second flexible element 7 is attached to the rigid link 3. In FIG. 2*a*, this point is represented by the dotted circle of radius R.

In an embodiment, the ratio of the radius R of the rigid ring 16 over the length L corresponds to about 0.6.

Figure 5:
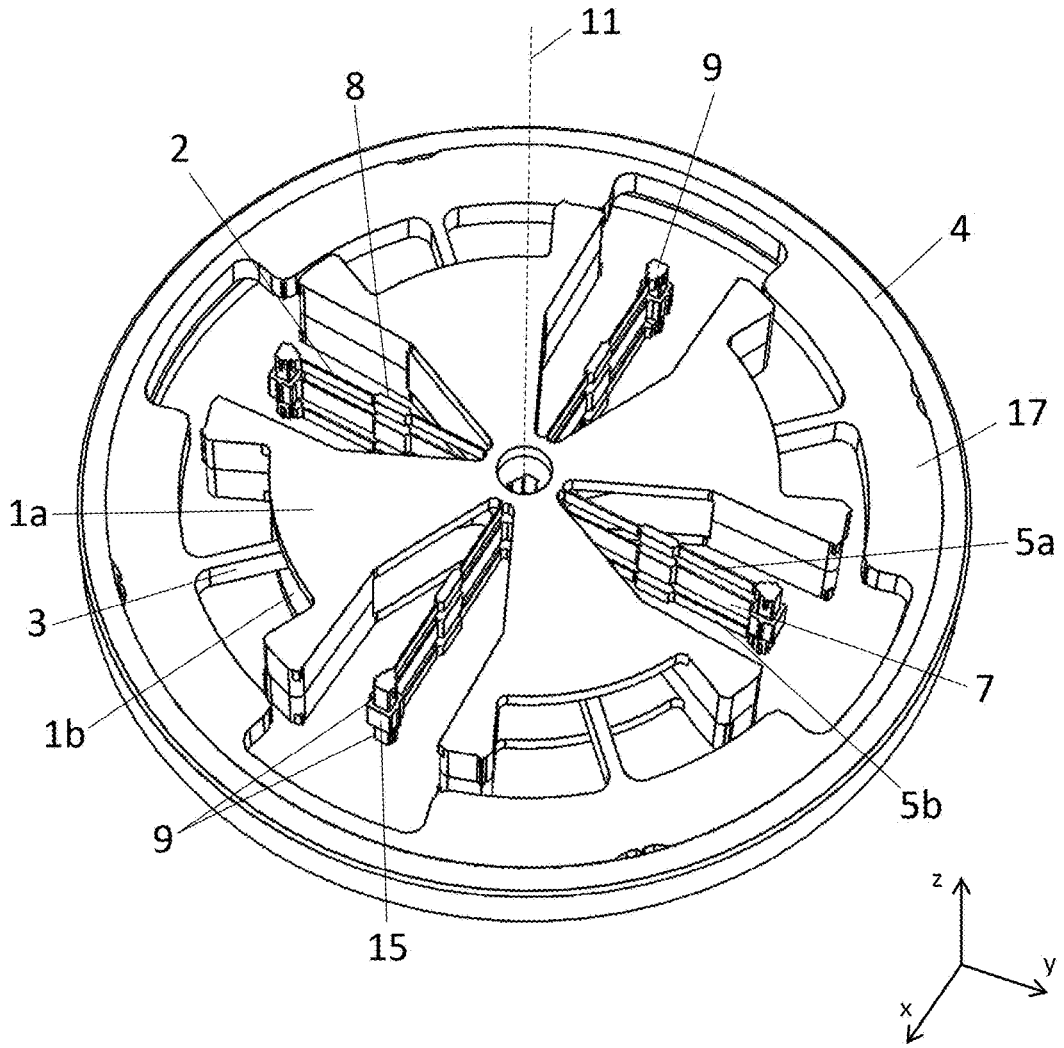
FIG. 5 represents a perspective view of the mechanical oscillator according to yet another embodiment.
Figure 6A:
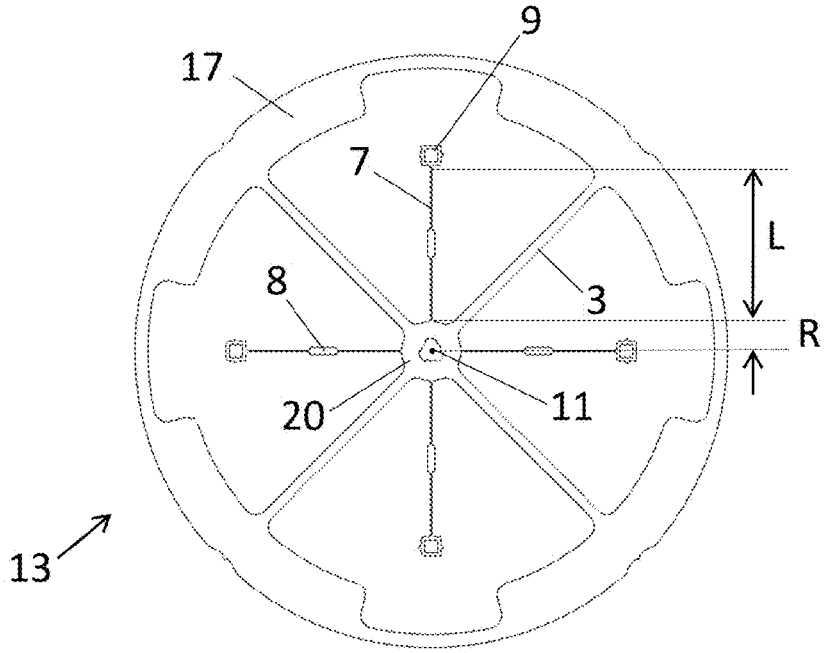
FIGS. 6*a* and 6*b* illustrate a top view of parts of the mechanical oscillator of FIG. 5.
Figure 6B:
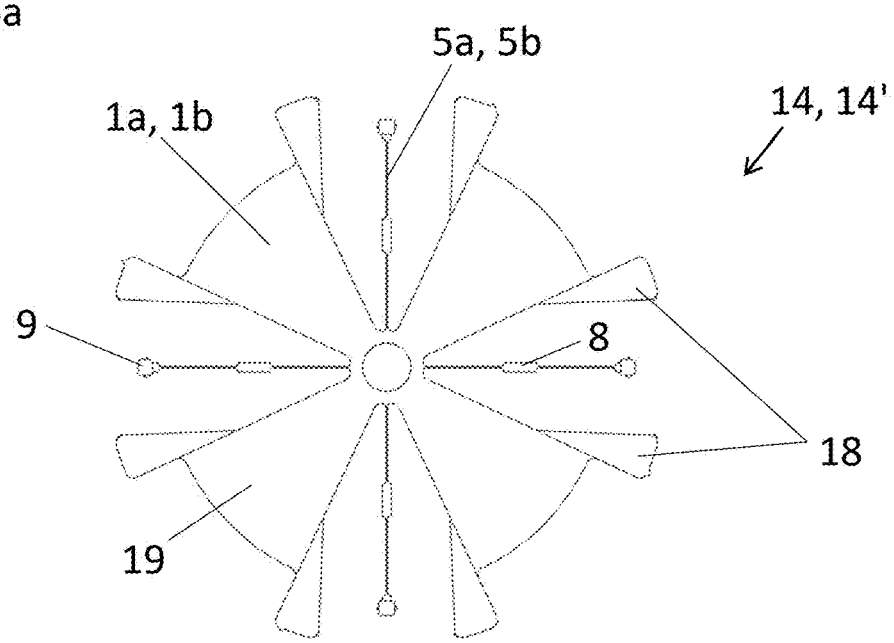

FIG. 5 shows a perspective view of the mechanical oscillator 10 according to yet another embodiment. FIGS. 6*a* and 6*b* illustrate a top view of the central part 13 and of the upper and lower parts 14, 14' of the mechanical oscillator 10 of FIG. 5. The configuration of the mechanical oscillator 10 shown in FIGS. 5, 6*a* and 6*b* is substantially the same as the one shown in FIG. 3. However, here, the first and second first flexible elements 5, 7 comprise a middle stiffening element 8. Moreover, the second blades 7 are fixed at their proximal extremity to the rigid links 3 via a rigid hub 20 having a radius that is smaller than the radius of the ring 16 shown in FIG. 4*b*. In other words, the central part 13 does not comprise the ring 16 and the rigid links 3 are directly connected to the rigid hub 20. In this configuration, the radius R corresponds to the radius of the rigid hub 20.

In an embodiment, the ratio R/L, of the length L over the radius R of the rigid hub 20 corresponds to about 0.2.

An optimal value of the ratio R/L, i.e. to obtain a good isochronism of the mechanical oscillator 10, depends on the dimensions of the flexible links 2, and thus on the dimensions of the first flexible element 5 (such as the first blades 5*a*, 5*b*) and the second flexible element 7 (such as the second blades 7), and on the Poisson's ratio of the material used to make the flexible links 2.

The optimal value of the ratio R/L can be determined by using a finite element method, for example, by using elements that can model an out-of-plane stress gradient, possibly taking into account large displacement hypothesis. Successive simulations can then be run such as to determine the ratio that corresponds to the specific configuration of the mechanical oscillator 10 and to a specific application.

An optimal value of the ratio R/L can further be determined by running by using an approximate empiric formula, when using silicon material with a Poisson modulus of about 0.28.

An optimal value of the ratio R/L can further be determined by adjusting the length of the flexible links 2 and/or the displacement (dimensions) of the fixation means 16, 20 of the flexible links 2. To this end, an adjusting device (not shown) can be included to the mechanical oscillator 10. By performing such adjustment and by measuring the oscillating frequency function of the amplitude a good isochronism of the mechanical oscillator 10 can be achieved.

Figure 11:
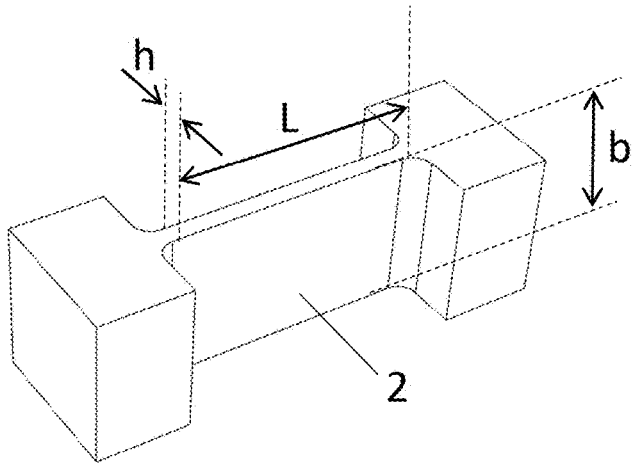
FIG. 11 is a schematic representation of the flexible link.

According to an embodiment, an optimal value of the ratio R/L is determined by using the empirical equation 1:

$$\rho_0(R_{el},R_{es})=6.38\cdot10^{-4}R_{el}^2-0.393\cdot R_{el}\cdot R_{es}+3.26\cdot10^{-2}\cdot R_{el}+5.408\cdot R_{es}-0.108$$

where $R_{el}$ is the slenderness ratio of the flexible link 2 and with $R_{el}$=L/b, where b is the width of the flexible link 2; $R_{es}$ is the slenderness ratio of the flexible link 2 cross-section, with $R_{es}$=h/b where h is the thickness of the flexible link 2. FIG. 11 is a schematic representation of the flexible link 2 showing the width b, the thickness b and the length L of the flexible link 2. The domain of validity of equation 1 is given by:

$$R_{el}\in[0,10]$$

and $$R_{es}\in[0,0.25]$$

Determining an optimal value of the ratio R/L allows for achieving a constant stiffness of the flexible links 2 and thus, an isochronous mechanical oscillator 10.

Isochronism deficiency can originate from a deformation of the flexible links 2 according to a non-natural axis implying a stiffening of the flexible links 2. This effect can be cancelled by using a ratio R/L being equal to about 0.6. Isochronism deficiency can further originate from the bending of the first flexible element 5 and the second flexible element 7 during the oscillation of the inertia rim 4. The bending depends on the dimensions of the first and second flexible elements 5, 7, in particular the bending amplitude increases with decreasing the thickness of the first and second flexible elements 5, 7 and with increasing their length. Here, the isochronism deficiency can be cancelled by decreasing the ratio R/L.

Figure 7:
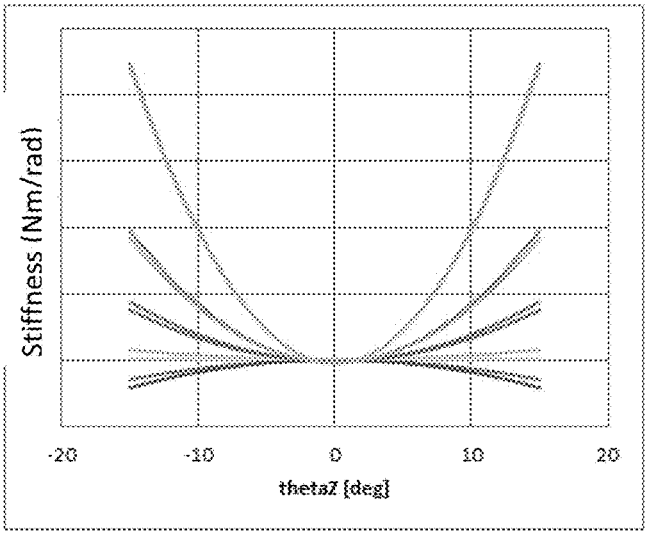
FIG. 7 shows the variation in the stiffness as a function of the amplitude of the angular movement of the inertial rim.
Figure 8:
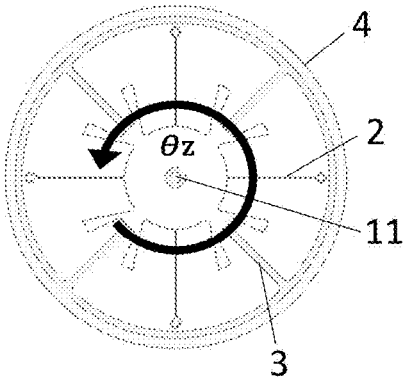
FIG. 8 illustrates an example of the angular movement of the inertial rim.

FIG. 7 shows the variation in the stiffness in Nm/rad calculated as a function of the amplitude $\theta_z$ of the angular movement of the inertial rim 4 (see FIG. 8) around the pivoting axis 11 of the mechanical oscillator 10 for several combinations of widths and lengths of the first and second flexible elements 5, 7. Depending on the combination of width and length of the first and second flexible elements 5, 7, the stiffness can increase or decrease with increasing amplitude $\theta_z$, from the unsolicited angular position $\theta_z$=0.

Figure 9:
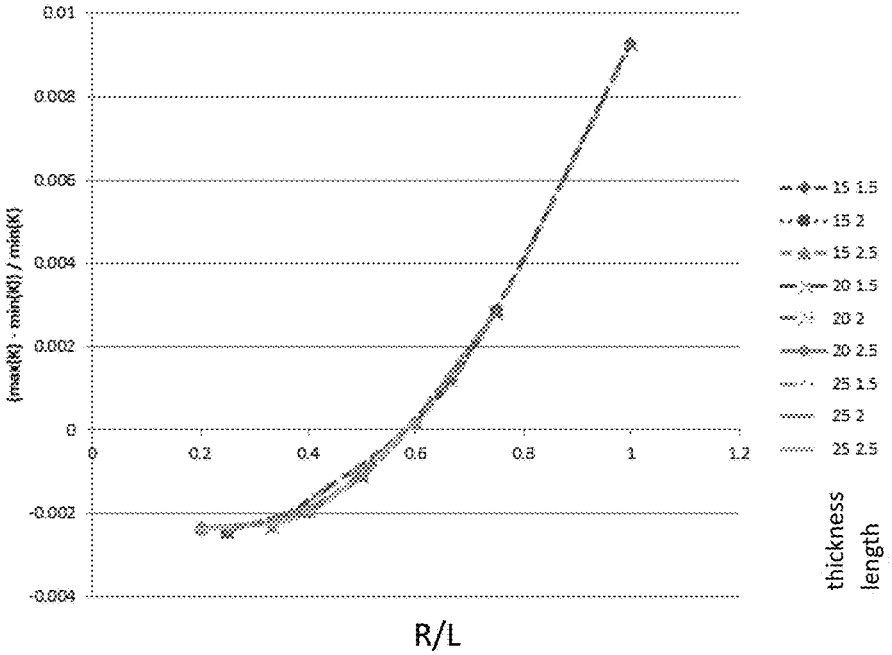
FIG. 9 reports variation of stiffness as a function geometrical features of the mechanical oscillator.

FIG. 9 reports the ratios (max(k)−min(k))/min(k) where max(k) is the calculated maximum stiffness and min(k) is the calculated minimum stiffness taken from FIG. 7 as a function of the ratio R/L, for the several combinations of widths and lengths of the first and second flexible elements 5, 7. FIG. 9 shows that for a ratio R/L of 0.6, max(k)=min(k), resulting in a constant stiffness of the first and second flexible elements 5, 7 and thus, an isochronous mechanical oscillator 10, when neglecting the Poisson modulus.

In an embodiment, the ratio R/L, is between 0.1 and 0.6, depending on the Poisson modulus.

The isochronism of the mechanical oscillator 10 can be influenced by external effects such as the maintenance of the oscillations of the mechanical oscillator 10 by an escapement or a variation in the inertia of the mechanical oscillator 10 when the latter oscillates. In that case, the ratio R/L, can be such that the external effects are compensated, i.e., the isochronism deficiency originating from a deformation of the flexible links 2 compensates the one due to the external effects. In other words, the ratio R/L can be selected such that the isochronism deficiency of the mechanical oscillator 10 is substantially null.

More particularly, a ratio R/L between 0.2 and 0.6 allows for obtaining an isochronism deficiency of the mechanical oscillator 10 as low as ±1.5 second per day for an amplitude $\theta_z$ of the angular movement between 10° and 15° (corresponding to phi0, ⅔*phi0) of the mechanical oscillator 10 around the pivoting axis 11. The ratio R/L can be between 0.05 and 0.6. Using a wider range of ratio R/L may result in a non-null isochronism deficiency. For instance, obtaining a negative isochronism deficiency may be useful for compensating a positive isochronism deficiency originating from an external perturbation (such as an escapement).

The material used to make the mechanical oscillator 10 disclosed herein is preferably silicon but can also include any other suitable materials such as quartz, glass, metallic glass, metal, polymer or any combination of these materials.

The mechanical oscillator 10 can be fabricated by using an suitable machining process including for example Deep Reaction Ion Etching (DRIE), Wire-Electro-Discharge Machine (w-EDM), femto-second laser structuring, LIGA, molding or classical machining of monolithic parts or assembled parts.

In the case silicon is used as material forming the mechanical oscillator 10, a correction of the thermal drift can be performed by adding a silicon oxide layer of an appropriate thickness. This correction can be made to cover a temperature range comprised between 8° C. and 38° C. The thickness of the oxide layer is usually comprised between 0 and 3 micrometers.

The inertia rim 4 provide the inertia of the mechanical oscillator 10. In the configurations of FIGS. 3 and 5, the inertia rim 4 can be formed integral with the external ring 17. Alternatively, the external ring 17 can be used as the inertia rim 4. In that case, the inertia is provided by the material used for machining the mechanical oscillator 10, made integral (the flexible elements 2, 5, 7 being made on the same material as the rigid elements 3, 4).

The oscillation frequency of the mechanical oscillator 10 can be adjusted by adjusting the inertia of the mechanical oscillator 10. This can be achieved, for example by adding, or removing, small quantities of material on the inertia rim 4. For instance, a material such as gold or any other adapted material can be deposited on the inertia rim 4. The added material has preferably a high density and can adhere well enough on the surface of the inertia rim 4. Other method than deposition can be used for adding and/or removing material, such as adding to the inertia rim 4 or cutting out from the inertia rim 4 pieces of material.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

Figure 10:
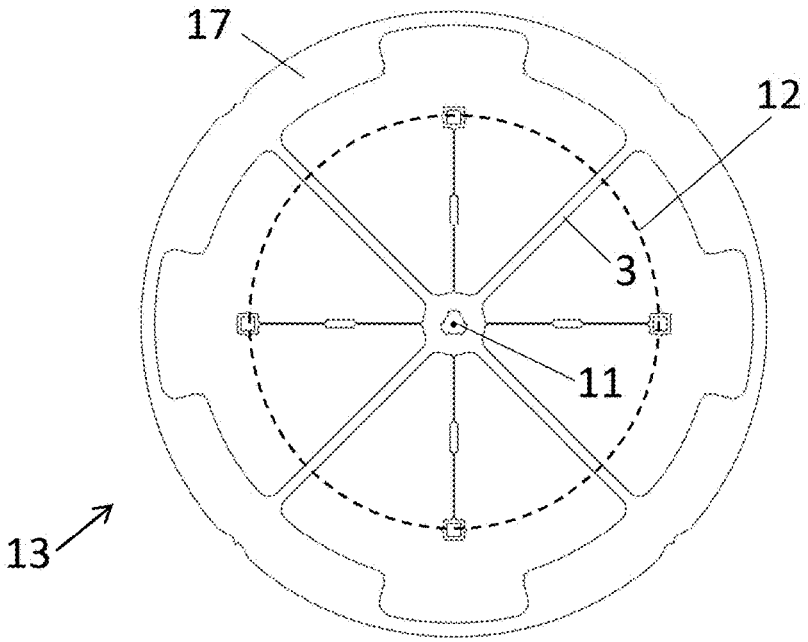
FIG. 10 represents a central part of the mechanical oscillator, according to another embodiment.

For example, the distal extremity of the first flexible elements 5 and the second flexible elements 7 can be linked by a coupling ring 12. Such coupling ring 12 is represented in FIG. 10 showing the central part 13 of the mechanical oscillator 10, wherein the coupling ring 12 is coupling the distal extremity of the second flexible elements 7. The coupling ring 12 allows for couplings the different vibration modes of the first and second flexible elements 5, 7. The coupling ring 12 is preferably made more compliant such that it becomes flexible, in order to avoid impeding a movement of the first and second flexible elements 5, 7 in the radial direction.

Moreover, other configurations of the mechanical oscillator 10 are possible. For example, the mechanical oscillator 10 can comprise at least two flexible links 2, for instance, three, four, five, six or eight flexible links 2. The mechanical oscillator 10 can comprise at least two rigid links 3, for instance, three, four, five, six or eight rigid links 3. The number of flexible links 2 need not to be equal to the number of rigid links 3.

The first flexible element 5 can comprise one or a plurality of coplanar first blades 5*a*, 5*b*, for example, more than two. Similarly, the second flexible element 7 can comprise a plurality of coplanar second blades.

REFERENCE NUMERAL USED IN THE FIGURES

1 central fixed part
1*a* first fixed part
1*b* second fixed part
2 flexible link
3 rigid link
4 inertia rim
5 first flexible element
5*a* first blade
5*b* first blade
6 rigid part
7 second flexible element, second blade
8 middle stiffening element
9 distal connecting element
10 mechanical oscillator
11 pivoting axis of the mechanical oscillator
12 coupling ring
13 central part
14 upper part
15 distal stiffening element
16 rigid ring
17 external ring
18 abutment
19 protruding portion
20 hub
$\theta_z$ amplitude of the angular movement

The invention claimed is:

1. Mechanical oscillator for a horological movement, the oscillator comprising:

a central fixed part being configured to be fixed to a frame of the horological movement;

an inertial rim coaxial with a pivoting axis of the mechanical oscillator;

at least two rigid links extending radially between the central fixed part and the inertial rim and supporting the inertial rim; and at least two flexible links extending radially from the central fixed part;

each flexible link comprising a first flexible element and a second flexible element substantially coplanar to the first element, the first flexible element and the second flexible element being rigidly connected at their distal extremity;

the proximal extremity of the first flexible element being fixed to the fixed part and the proximal extremity of the second flexible element being fixed to one of said at least two rigid links, such that the inertial rim can oscillate around the pivoting axis;

the first flexible element comprising two first blades and the second flexible element comprises one second blade coplanar with said first blades; wherein the second blade is between the two first blades.

2. The mechanical oscillator according to claim 1, wherein the first flexible element and the second flexible element are configured to bend substantially perpendicular to their radial extension.

3. The mechanical oscillator according to claim 1, wherein the ratio of a radius, corresponding to a distance between the proximal extremity of the second flexible element and the pivoting axis, over a length of the flexible link is between 0.2 and 0.6.

4. The mechanical oscillator according to claim 3, wherein said ratio is such that the isochronism of the oscillator is ±1.5 second per day for an amplitude of the angular movement between 10° and 15°.

5. The mechanical oscillator according to claim 1, wherein said at least two flexible links comprises three, four, five, six or eight flexible links; and/or said at least two rigid links comprises three, four, five, six or eight rigid links.

6. The mechanical oscillator according to claim 1, wherein the first flexible element comprises a plurality of coplanar first blades and wherein the second flexible element comprises at least one second blade coplanar with said plurality of coplanar first blades.

7. The mechanical oscillator according to claim 6, wherein said plurality of coplanar blades comprises two first blades arranged on each side of one second blade.

8. The mechanical oscillator according to claim 7, wherein the second blade has a width that is substantially twice the width of the two first blades.

9. The mechanical oscillator according to claim 1, wherein each of the first flexible element and the second flexible element comprises at least one stiffening element.

10. The mechanical oscillator according to claim 9, wherein a middle stiffening element is comprised in a middle portion of the first and second flexible elements.

11. The mechanical oscillator according to claim 9, wherein a distal stiffening element is comprised at the distal extremity of the first and second flexible elements.

12. The mechanical oscillator according to claim 1, wherein the distal extremity of the first flexible elements and the second flexible elements are linked by a coupling ring.

13. The mechanical oscillator according to claim 1, being made in one of silicon, quartz, glass, metallic glass, metal, polymer or any combination of these materials.

14. A horological movement comprising a mechanical oscillator comprising a central fixed part being configured to be fixed to a frame of the horological movement; an inertial rim coaxial with a pivoting axis of the mechanical oscillator; at least two rigid links extending radially between the central fixed part and the inertial rim and supporting the inertial rim; and at least two flexible links extending radially from the central fixed part; each flexible link comprises comprising a first flexible element and a second flexible element substantially coplanar to the first element, the first flexible element and the second flexible element being rigidly connected at their distal extremity; the proximal extremity of the first flexible element being fixed to the fixed part and the proximal extremity of the second flexible element being fixed to one of said at least two rigid links, such that the inertial rim can oscillate around the pivoting axis; the first flexible element comprising two first blades and the second flexible element comprises one second blade coplanar with said first blades; wherein the second blade is between the two first blades.

15. A timepiece comprising the horological movement according to claim 14.

* * * * *